US007833035B2

(12) United States Patent
Lin et al.

(10) Patent No.: US 7,833,035 B2
(45) Date of Patent: Nov. 16, 2010

(54) ELECTRICAL CONNECTOR

(75) Inventors: Min-Han Lin, Tu-cheng (TW); Kuo-Chun Hsu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 279 days.

(21) Appl. No.: 12/228,554

(22) Filed: Aug. 13, 2008

(65) Prior Publication Data

US 2009/0047833 A1 Feb. 19, 2009

(30) Foreign Application Priority Data

Aug. 14, 2007 (TW) ..... 96129921 A

(51) Int. Cl.
*H01R 13/62* (2006.01)

(52) U.S. Cl. ..... 439/260; 439/495

(58) Field of Classification Search ..... 439/630, 439/260–261, 267, 494–497, 924.1, 79, 341, 439/326, 499
See application file for complete search history.

(56) References Cited

U.S. PATENT DOCUMENTS 7,147,498 B1 * 12/2006 Gillespie et al. ..... 439/260
7,361,042 B2 * 4/2008 Hashimoto et al. ..... 439/260
7,524,204 B2 * 4/2009 Shimada et al. ..... 439/260
2006/0141837 A1 * 6/2006 Okano ..... 439/260

FOREIGN PATENT DOCUMENTS

JP 3513751 B2 1/2002

* cited by examiner

*Primary Examiner*—Edwin A. Leon
(74) *Attorney, Agent, or Firm*—Andrew C. Cheng; Wei Te Chung; Ming Chieh Chang

(57) ABSTRACT

An electrical connector for connecting an FPC includes an insulating housing having a receiving space, a plurality of contacts received in the insulating housing and an actuator retained on two ends of said insulating housing. Each contact includes a pivot arm engaging with said actuator and frontwardly extending into said receiving space. Said pivot arm defines a first engaging notch and a protrusion on a bottom edge thereof. The actuator has a rotatable cam portion rotatablely engaged with said first engaging notch. Said protrusion is formed on a frontal tip end of said pivot arm and extends much lower than said rotatable cam portion in a vertical direction, which prevents the FPC from contacting with said rotatable portion firstly during the process of the insertion.

15 Claims, 4 Drawing Sheets

ELECTRICAL CONNECTOR

BACKGROUND OF THE INVENTION

1. Field of the Invention

The present invention relates to an electrical connector, and more particularly to an electrical connector connecting an FPC (Flexible Printed Circuit) to a PCB (printed circuit board).

2. Description of Related Art

An electrical connector for connecting an FPC is widely used in electronics device nowadays. As disclosed in JP. Pat. No. 3513751B2, an FPC electrical connector comprises a housing having a receiving space, a plurality of contacts each of which has an upper pivot arm, and a rotatable actuator having a cam portion to engage with the upper pivot arm. Said FPC has a front side edge which inserts into said receiving space firstly. The cam portion of the actuator is located much closer to an opening of the receiving space than a frontal tip end of the upper pivot arm, so in the process of the insertion of said FPC, said front side edge of the FPC may push against the cam portion firstly and drive the actuator to rotate from an open position to a close position before the FPC is fully inserted into said receiving space, which may prevent the FPC from having a deeper insertion into said receiving space.

So it is necessary to provide a new electrical connector to solve the problems above.

SUMMARY OF THE INVENTION

Accordingly, an object of the present invention is to provide an electrical connector for connecting an FPC, in which the FPC is easy to be inserted.

In order to achieve above-mentioned object, an electrical connector is provided which comprises an insulating housing having a plurality of passageways and a receiving space, a plurality of contacts received in said passageways, and an actuator having a rotating portion rotatablely engaging with said pivot arm. Each contact has a contacting arm and a pivot arm frontwards extending into said receiving space. Said pivot arm of the contact has a protrusion thereof which is formed on a front side of said rotating portion and at least extends downwardly to a same level with the rotating portion.

Other objects, advantages and novel features of the present invention will become more apparent from the following detailed description of the present embodiment when taken in conjunction with the accompanying drawings.

DETAILED DESCRIPTION OF THE INVENTION

The present invention shall be discussed hereinafter in terms of a preferred embodiment illustrated in the accompanying drawings. In the following description, numerous specific details are set forth in order for the reader hereof to gain a thorough understanding of the present invention. It will be obvious, however, to those skilled in the art that certain well-know elements may not be shown in detail in order to unnecessarily obscure the present invention.

Figure 1:
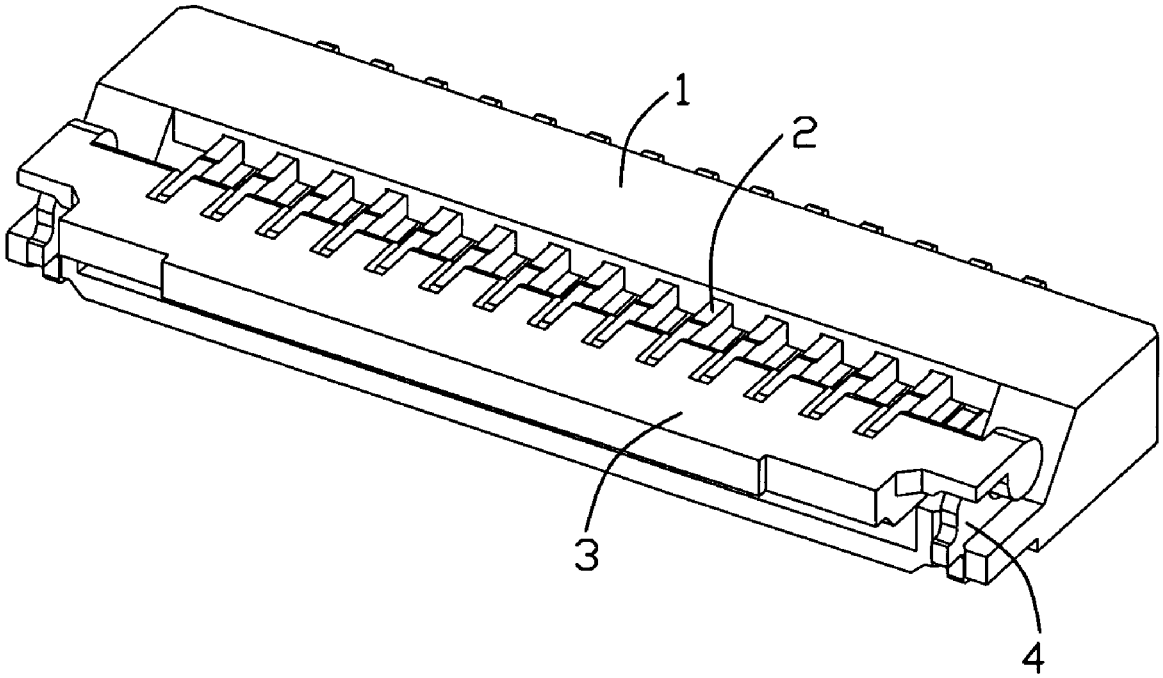
FIG. 1 is an assembled, perspective view of an electrical connector in accordance with an embodiment of the present invention.
Figure 2:
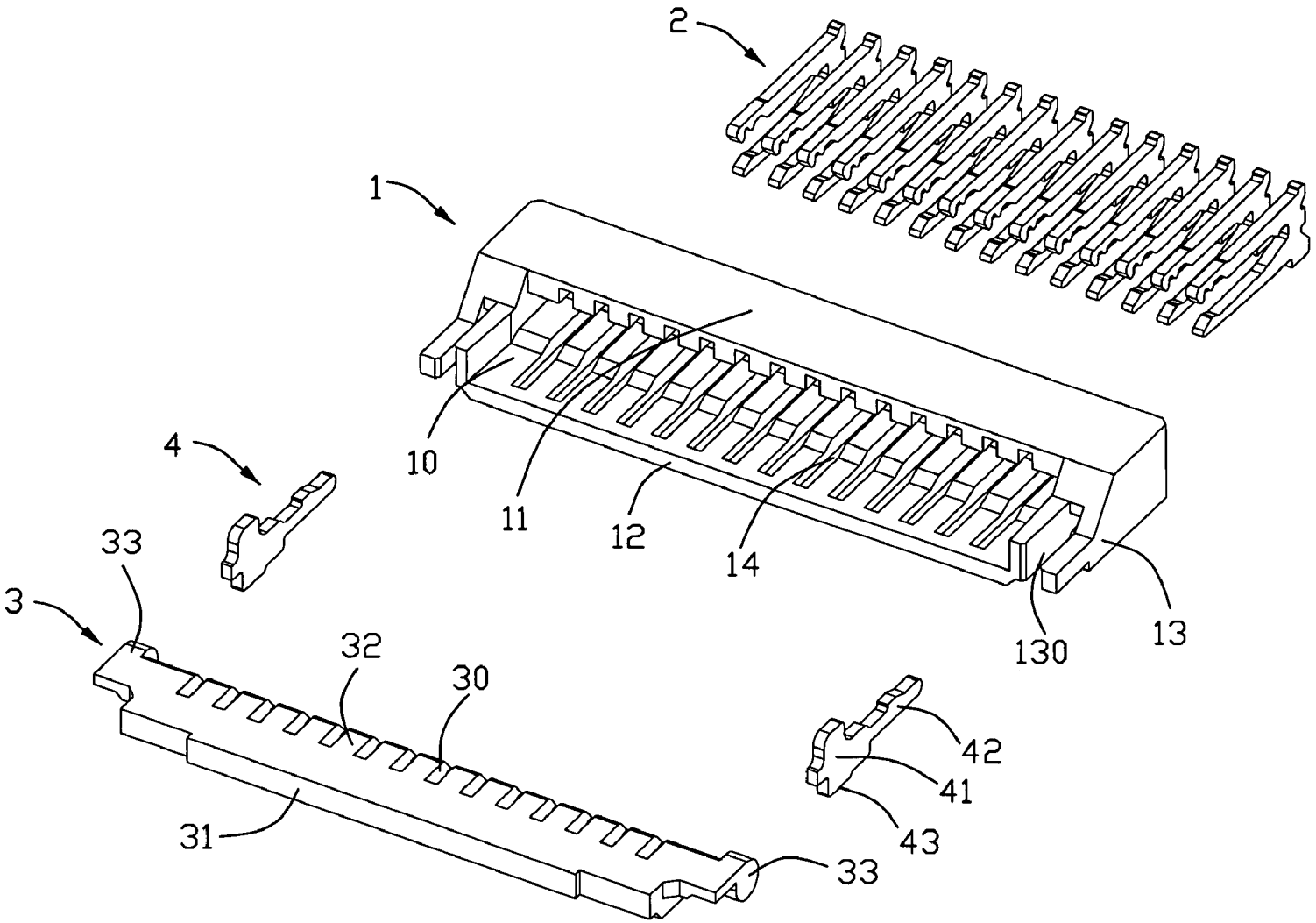
FIG. 2 is an exploded, perspective view of the electrical connector in accordance with the embodiment of the present invention.

Referring to FIGS. 1 and 2, an electrical connector in accordance with the present invention is provided. The electrical connector comprises an insulating housing 1, a plurality of contacts 2 retained in said insulating housing 1, a rotatable actuator 3 assembled on said insulating housing 1 and a pair of retaining member 4 retained in two ends of said insulating housing 1.

Referring to FIG. 2, the insulating housing 1 includes a top wall 11, a bottom wall 12 and a pair of sidewalls 13 connecting with said top wall 11 and said bottom wall 12, which defines a receiving space 10 for receiving an FPC. A plurality of passageways 14 are formed on an inner surface of both said top wall and bottom wall to pass through into said receiving space 10. Each said sidewall 13 has a slot 130 receiving each said retaining member 4 for retaining the electrical connector on a printed circuit board firmly.

Figure 3:
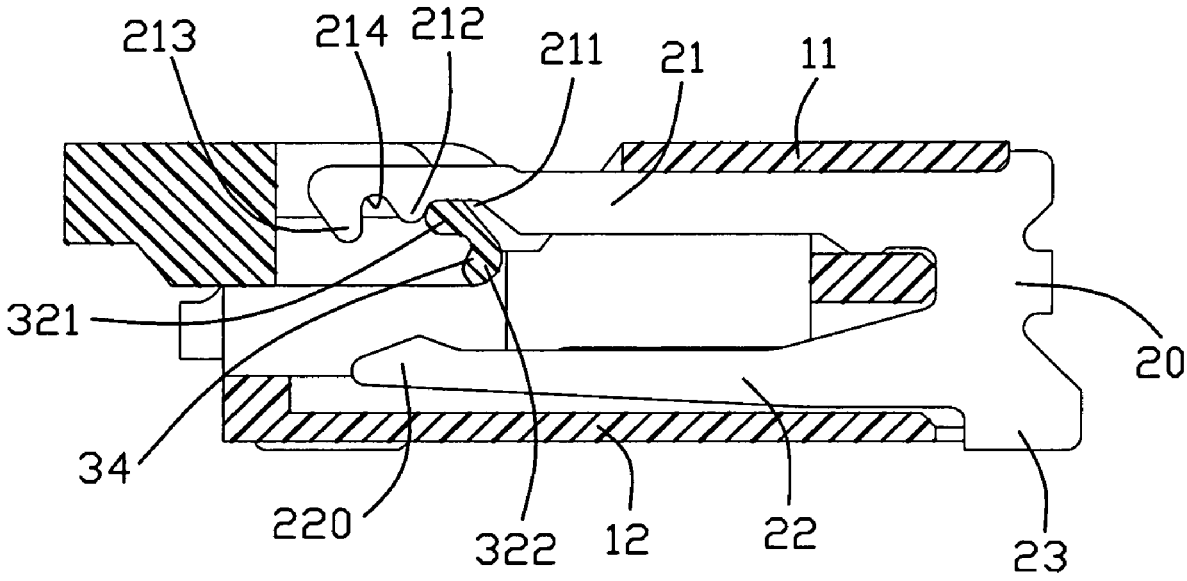
FIG. 3 is a cross-section view of the electrical connector taken along line 3-3 of FIG. 1, showing the actuator on a locking position.

Referring to FIG. 3, each contact 2, which is forwardly assembled into said passageway 14 of the insulating housing 1 from the back, comprises a base portion 20, a pivot arm 21 extending into said receiving space 10 horizontally from a top edge of the base portion 20, a contacting arm 22 extending from a bottom edge of the base portion 20 parallel to said pivot arm 21, and a soldering leg 23 downwardly extending from said base portion 20. The pivot arm 21 has a longitudinal body which defines a pivot portion and a protecting portion on a bottom edge of a front end thereof. Said pivot portion comprises a first engaging notch 211, a second engaging notch 214 and a projecting portion 212 between said two notches. Said protection portion includes a protrusion 213 which is formed on a frontal tip end of the pivot arm 21 and near a front side of said receiving space 10. The protrusion 213 has a slanted surface for guiding the FPC and extends much lower than said projecting portion 212 in a vertical direction, which makes the FPC insert into the receiving space much easier by contacting with the protrusion 213 firstly. Said second engaging notch 214 is formed between said projecting portion 212 and protrusion 213.

Referring to FIG. 2, said actuator 3, which rotates between an opening position and a locking position, includes a longitudinal operating portion 31 and a rotating portion 32 formed on a lateral side of said operating portion 31 with a plurality of grooves 30 defined thereon for receiving the pivot arms 21 of the contacts 2. Combine with FIG. 3, said rotating portion 32 has a pair of spindles 33 on two longitudinal ends thereof for engaging with the insulating housing 1 rotatablely, a cam portion 321 rotatablely engaging with said first engaging notch 211, and a stiffening rib 322 extending downwardly from said cam portion 321 for engaging with said second engaging notch 214. A concave 34 is defined between said cam portion 321 and said stiffening rib 322 for engaging with said projecting portion 212 of the contact 2.

As shown in FIG. 2, said retaining member 4 includes a base portion 41, a retaining bar 42 extending from said base portion 41 for retained into said slots 130 of the insulating housing 1, and a soldering portion 43 formed on a bottom edge of said base portion 41 for retaining on the printed circuit board firmly. The retaining bar 42 sustains said spindles of said rotating portion 32, which makes it easier for said actuator 3 for rotating between said opening position and said locking position.

Figure 4:
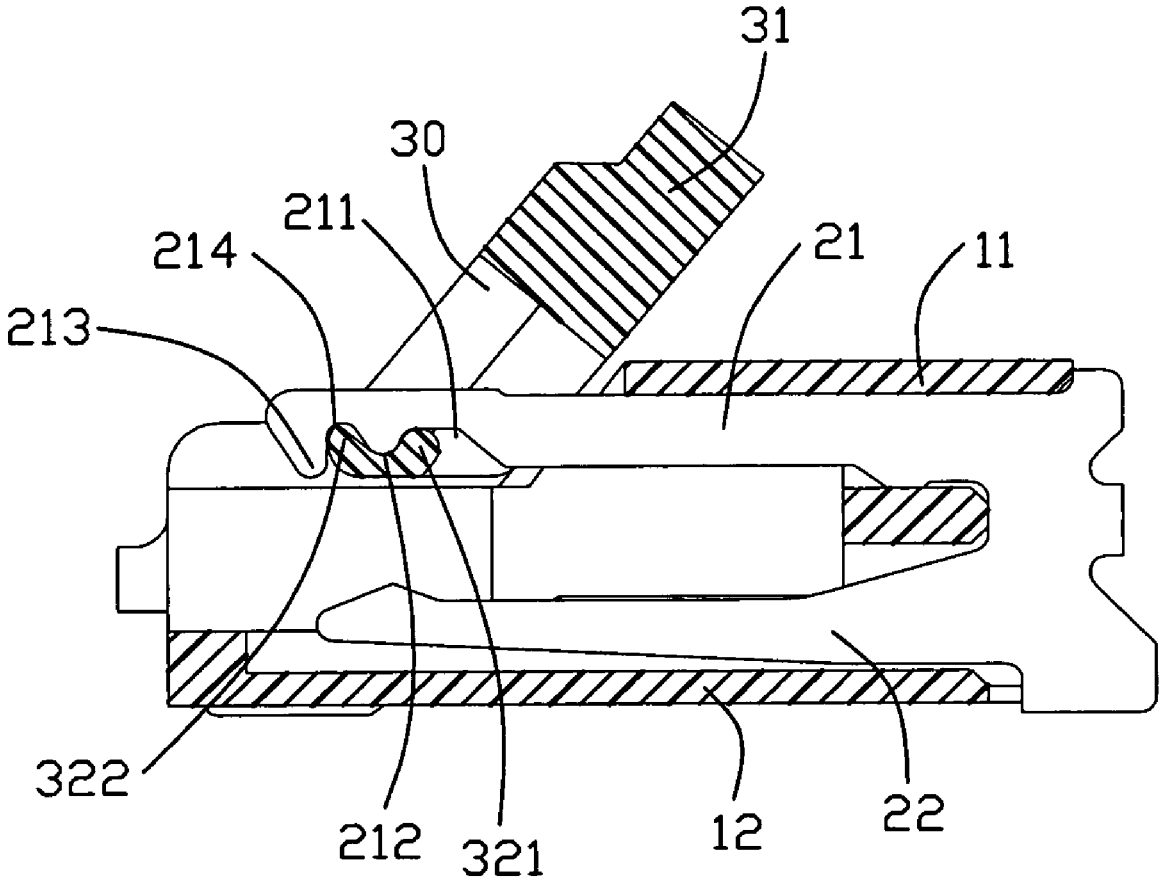
FIG. 4 is another cross-section view similar to FIG. 3, showing the actuator on an opening position.

Referring to FIG. 4, when the actuator 3 is at the opening position, at which said FPC can be inserted into said receiving space 10 of the insulating housing 1, the cam portion 321 and the stiffening rib 322 of the actuator 3 are received into said first engaging notch 211 and said second engaging notch 214 of the contact 2 respectively, while the projecting portion 212 is received into said concave 34 of the rotating portion 32. Said protrusion 213 at least extends to a same level with said rotating portion 32 in a vertical direction in order to protect the rotating portion 32 in an inserting direction. Thus, during the insertion of the FPC, the FPC will contact with the protrusion 213 firstly, which will not drive the actuator 3 rotating. In other embodiment of the invention, said protrusion 213 also can extend much lower than said rotating portion 32 in a vertical direction to prevent the FPC from contacting with the rotating portion 32 firstly. Referring to FIG. 3, when the actuator 3 rotates around the cam portion 321 to the locking position, said stiffening rib 322 rotates outwardly from said second engaging notch 214 and urges a top surface of the FPC (not shown) toward the contacting arm 22 of the contact 2 for electrical connection.

However, while the preferred embodiment of the invention has been shown and described, it will apparent to those skilled in the art that changes and modifications may be made therein without departing from the spirit of the invention, the scope of which is defined by the appended claims.

What is claimed is:

1. An electrical connector comprising:

an insulating housing having a plurality of passageways and a receiving space;

a plurality of contacts received in said passageways, each contact having a contacting arm and a pivot arm frontwards extending into said receiving space; and an actuator having a rotating portion rotatablely engaging with said pivot arm; wherein said pivot arm of the contact has a protrusion thereof, the protrusion is located in front of said rotating portion and at least extends downwardly to a same level regarding with the rotating, wherein said protrusion is formed on a front tip end of said pivot arm and has a guiding surface, wherein said pivot arm has a projecting portion formed on an inner side of said protrusion, said protrusion has a bottom tip end which is lower than said projecting portion, wherein said pivot arm of the contact has a first engaging notch and a second engaging notch formed on a bottom edge thereof, said two notches are spaced by said projecting portion.

2. The electrical connector as claimed in claim 1, wherein said rotating portion has cam portion rotatablely engaging with said first engaging notch.

3. The electrical connector as claimed in claim 1, wherein said contacting arm and a pivot arm are assembled into said insulating housing from a backside and extend into said receiving space horizontally respectively.

4. The electrical connector as claimed in claim 3, wherein said rotating portion has a cam portion and a stiffening rib, both of which are located behind said protrusion of the pivot arm.

5. The electrical connector as claimed in claim 4, wherein said cam portion and said stiffening rib define a concave therebetween for engaging with said pivot arm.

6. The electrical connector as claimed in claim 5, wherein the pivot arm defines a notch on a bottom edge thereof which is behind said protrusion for engaging with said stiffening rib.

7. The electrical connector as claimed in claim 6, wherein said actuator rotates from an opening position to a locking position while the stiffening rib rotates outwardly from said notch.

8. An electrical connector for use with a flexible printed circuit (FPC) comprising:

an insulative housing defining a transverse receiving slot being forwardly open to an exterior for receiving said FPC;

a plurality of passageways disposed in the housing and communicating with the receiving slot;

a plurality of contacts respectively disposed in the corresponding passageways, each of said contacts including a contacting section extending into the receiving slot, an actuator pivotally mounted upon the housing and defining a front operation portion and a rear rotation portion, said rotation portion defining a plurality of parallel grooves each extending along a front-to-back direction and being equipped with therein a cam portion extending in a transverse direction perpendicular to said front-to-back direction;

a plurality of pivot arms disposed in the housing and engaged with the corresponding cam portions, respectively; and a plurality of protrusions located around front ends of the corresponding pivot arms, respectively; wherein the rotation portion not only engages the corresponding pivot arms for guiding rotation of the actuator between an open position and a closed position but also invades, at the closed position, the receiving slot in a vertical direction perpendicular to both said front-to-back direction and said transverse direction for pressing said FPC against the corresponding contacting sections, under a condition that at the open position the rotation portion leaves and is spaced from the receiving slot at a first level which is farther from the receiving slot in the vertical direction than a second level defined by said protrusions so as to assure insertion of the FPC along said front-to-back direction will not jeopardize the rotation portion.

9. The electrical connector as claimed in claim 8, wherein the protrusions are unitarily formed with the corresponding pivot arms, respectively.

10. The electrical connector as claimed in claim 8, wherein the pivot arms are unitarily formed with the corresponding contacts, respectively.

11. The electrical connector as claimed in claim 8, wherein the pivot arms are aligned with the corresponding contacts, respectively, in the vertical direction.

12. The electrical connector as claimed in claim 8, wherein each of said pivot arm forms a projecting portion behind the corresponding protrusion but in front of the corresponding cam portion in said front-to-back direction to engage said corresponding cam portion during rotation of the actuator.

13. The electrical connector as claimed in claim 12, wherein each groove is further equipped with a stiffening rib unitarily linked to the corresponding cam portion to commonly engage the corresponding projecting portion when said actuator is rotated to the open position under a condition that the projecting portion is located between the corresponding cam portion and stiffening rib in the front-to-back direction.

14. An electrical connector for use with a flexible printed circuit (FPC) comprising:

an insulative housing defining a transverse receiving slot being forwardly open to an exterior for receiving said FPC;

a plurality of passageways disposed in the housing and communicating with the receiving slot;

a plurality of contacts respectively disposed in the corresponding passageways, each of said contacts including a contacting section extending into the receiving slot, an actuator pivotally mounted upon the housing and defining a front operation portion and a rear rotation portion, said rotation portion defining a plurality of parallel grooves each extending along a front-to-back direction and being equipped with therein a cam portion extending in a transverse direction perpendicular to said front-to-back direction;

a plurality of pivot arms disposed in the housing and engaged with the corresponding cam portions, respectively; and the rotation portion not only engaging the corresponding pivot arms for guiding rotation of the actuator between an open position and a closed position but also invading, at the closed position, the receiving slot in a vertical direction perpendicular to both said front-to-back direction and said transverse direction for pressing said FPC against the corresponding contacting sections, wherein each of said pivot arm forms a projecting portion in front of the corresponding cam portion in said front-to-back direction to engage the corresponding cam portion during rotation of the actuator; and each groove is further equipped with a stiffening rib unitarily linked to the corresponding cam portion to commonly engage the corresponding projecting portion when said actuator is rotated to the open position under a condition that the projecting portion is located between the corresponding cam portion and stiffening rib in the front-to-back direction.

15. The electrical connector as claimed in claim 14, wherein a protrusion is located in front of the corresponding projecting portion so as to cooperate with the corresponding projecting portion to sandwich the corresponding stiffening rib therebetween in said front-to-back direction.

* * * * *